US011441375B2

(12) United States Patent
Roane et al.

(10) Patent No.: US 11,441,375 B2
(45) Date of Patent: Sep. 13, 2022

(54) METHODS AND TOOLS TO DEPLOY DOWNHOLE ELEMENTS

(71) Applicant: Halliburton Energy Services, Inc., Houston, TX (US)

(72) Inventors: Thomas Owen Roane, Alvord, TX (US); Zheng Guan, McKinney, TX (US); Benjamin Jon Wellhoefer, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 301 days.

(21) Appl. No.: 16/484,416

(22) PCT Filed: Dec. 19, 2018

(86) PCT No.: PCT/US2018/066522

§ 371 (c)(1),
(2) Date: Aug. 7, 2019

(87) PCT Pub. No.: WO2020/131051

PCT Pub. Date: Jun. 25, 2020

(65) Prior Publication Data

US 2021/0363844 A1 Nov. 25, 2021

(51) Int. Cl.

| | |
|---|---|
| ***E21B 23/06*** | (2006.01) |
| ***E21B 23/04*** | (2006.01) |
| ***E21B 34/06*** | (2006.01) |

(52) U.S. Cl.

CPC ..... *E21B 23/06* (2013.01); *E21B 23/0413* (2020.05); *E21B 23/0422* (2020.05); *E21B 34/063* (2013.01)

(58) Field of Classification Search

CPC .... E21B 34/10; E21B 34/063; E21B 23/0413; E21B 23/0422; E21B 23/06

See application file for complete search history.

(56) References Cited

U.S. PATENT DOCUMENTS 6,295,914 B1 10/2001 Iversen
7,467,661 B2 * 12/2008 Gordon ..... E21B 43/112 166/298

(Continued)

FOREIGN PATENT DOCUMENTS

CN 103392050 A 11/2013

OTHER PUBLICATIONS

International Search Report and Written Opinion dated Sep. 19, 2019 in PCT/US2018/066522 filed on Dec. 19, 2018 (14 pages).

*Primary Examiner* — Christopher J Sebesta
(74) *Attorney, Agent, or Firm* — McGuireWoods LLP

(57) ABSTRACT

The embodiments include methods and tools to activate downhole apparatuses. In one embodiment, a hydrostatic pressure intensifier includes a housing having at least two different internal cross-sectional surface areas. The housing includes a device mounted on the housing and operable to actuate in response to being subject to a threshold amount of pressure. The housing also includes a first piston housed in a first chamber of the housing, where the first piston has a first cross-sectional area and a first stroke length, and a second piston housed in a second chamber of the housing, where the second piston has a second cross-sectional area and a second stroke length, and where the first cross-sectional area is greater than the second cross-sectional area. The hydrostatic pressure intensifier also includes a fluid flow restrictor that restricts fluid flow through the valve to control an amount of pressure applied by the first piston.

20 Claims, 4 Drawing Sheets

(56) References Cited

U.S. PATENT DOCUMENTS

| | | | | |
|---|---|---|---|---|
| 9,175,532 | B2 | 11/2015 | Nikiforuk et al. | |
| 9,217,309 | B2 | 12/2015 | Kalb et al. | |
| 9,316,077 | B2 * | 4/2016 | Clemens | E21B 23/08 |
| 9,790,764 | B2 | 10/2017 | Ezell | |
| 2005/0230122 | A1 | 10/2005 | Cho et al. | |
| 2009/0317267 | A1 | 12/2009 | Gill et al. | |
| 2013/0140041 | A1 * | 6/2013 | Allen | E21B 33/12 166/387 |
| 2014/0190708 | A1 | 7/2014 | Hallundbaek | |
| 2015/0315871 | A1 * | 11/2015 | Fripp | E21B 34/063 166/374 |

* cited by examiner

METHODS AND TOOLS TO DEPLOY DOWNHOLE ELEMENTS

BACKGROUND

The present disclosure relates generally to methods and tools to activate downhole apparatuses.

Mechanical and electrical tools are sometimes used to activate downhole apparatuses, such as to set packers, in a wellbore. Power lines are sometimes run downhole to provide power to such tools. However, a wellbore may be several thousand feet long. As such, the cost and technical difficulties associated with running power lines downhole to deploy a downhole element increase the further downhole the element is deployed. Hydraulic tools that utilize hydraulic pressure applied from the surface are sometimes used to activate downhole apparatuses. However, in certain applications it is difficult to apply sufficient hydraulic pressure from the surface to deploy the downhole element at the desired downhole location.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

Figure 1A:
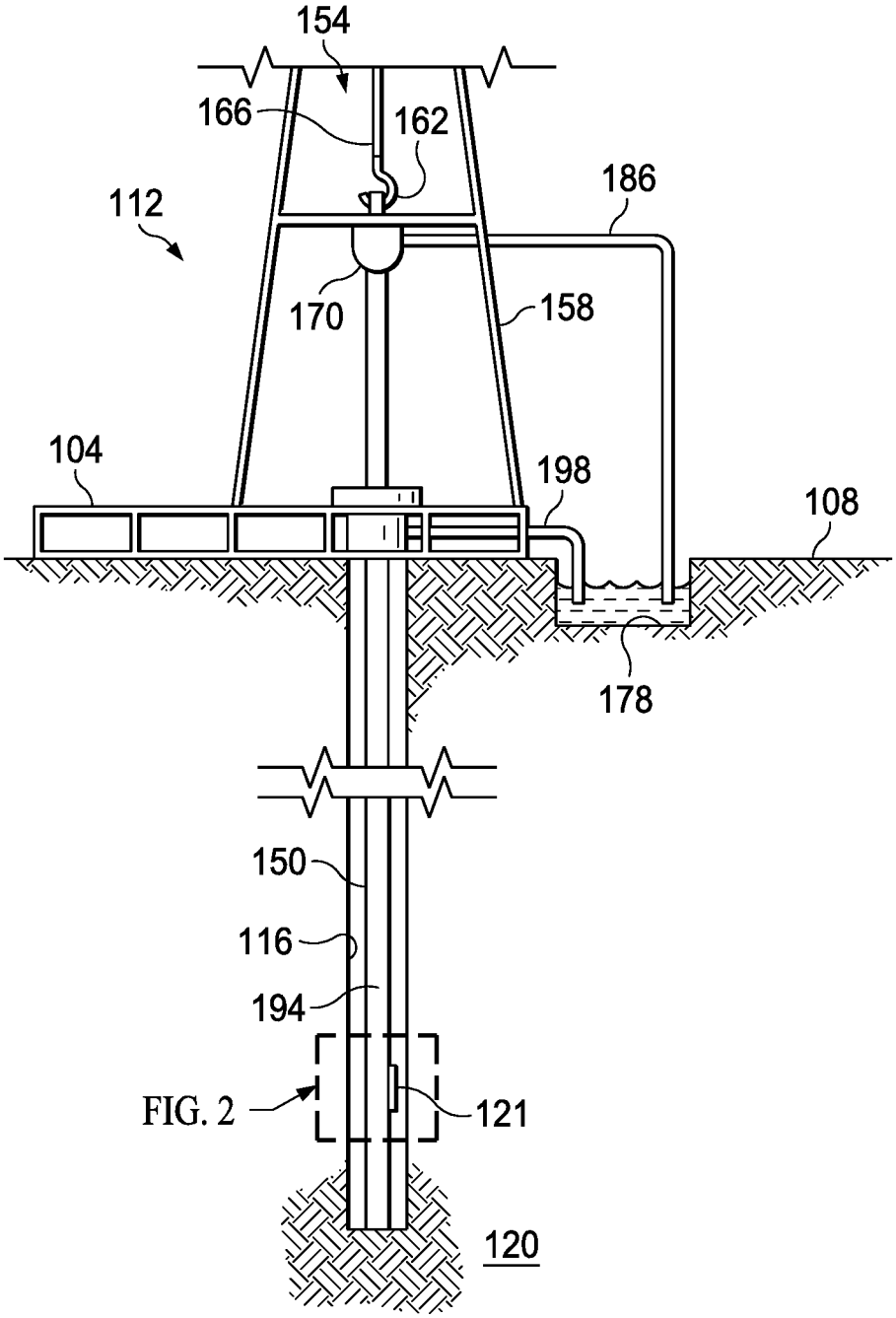
FIG. 1A illustrates a schematic view of an on-shore well having a hydrostatic pressure intensifier deployed in the well.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to methods and tools to activate downhole apparatuses, such as setting packers in a borehole. In some embodiments, the tool is a hydrostatic pressure intensifier that includes a housing having an interior with two different internal cross-sectional surface areas. The housing unit houses a first piston that has a first stroke length and a first cross-sectional area, and a second piston that has a second cross-sectional area where the first cross-sectional area of the first piston is greater than the second cross-sectional area of the second piston. The first piston and the second piston are positioned at locations where an actuation of the first piston causes (either directly or indirectly) the second piston to actuate. In some embodiments, the first piston and the second piston are mechanically linked to each other, where a force applied to the first piston is transferred via the mechanical link to the second piston. The second piston is positioned proximate to a downhole element (e.g., packer), where the actuation of the second piston applies a force to the downhole element. In some embodiments, the downhole element is retained by the hydrostatic pressure intensifier. In one or more of such embodiments, the hydrostatic pressure intensifier has a retaining element, such as a retaining ring, a shear ring, or another type of element that retains the downhole element to the hydrostatic pressure intensifier if the retaining element is not subject to a threshold amount of pressure. Additional descriptions of the retaining element, as well as applying a threshold amount of pressure to the retaining element, are provided in the paragraphs below. In some embodiments, the housing also includes a chamber that separates the first piston from the second piston when the pistons are not actuated. In one or more of such embodiments, the chamber is a fluid chamber that is partially or completely filled with a fluid. In one or more of such embodiments, the chamber is an atmospheric chamber.

The hydrostatic pressure intensifier also includes a device that is mounted on the housing and operable to actuate in response to being subject to a threshold amount of pressure. The device, after it is actuated, provides an opening for a downhole fluid (e.g., formation fluid, drilling fluid, or another type of fluid flowing in the borehole) to flow into the interior of the housing. In one or more of such embodiments, the device is a valve (e.g., a check valve) that opens in response to being subject to the threshold amount of pressure. In one or more of such embodiments, the device is a shiftable sleeve that actuates to provide an opening into the housing. In one or more of such embodiments, the device is a rupture disc or another type of non-reclosing pressure relief device having a membrane that fails when subject to the threshold amount of pressure. In one or more embodiments, the device is formed from a dissolvable or degradable substance that dissolves or degrades when the substance is in contact with the downhole fluid.

After the device is actuated, fluid previously flowing around the hydrostatic pressure intensifier flows into the housing and applies a force to the first piston, thereby actuating the first piston. The first piston, in response to the force applied by the fluid, actuates and applies a force to the second piston, thereby actuating the second piston. In some embodiments, the force applied by the fluid to the first piston is approximately equal to the force applied by the first piston to the second piston. However, due to the differences between the cross-sectional areas of the first piston and the second piston, the amount of pressure the first piston is subject to is different from the amount of pressure the second piston is subject to. More particularly, given that the cross-sectional area of the second piston is less than the cross-sectional area of the first piston, an approximately equal amount of force applied to both pistons would cause the second piston to be subject to and also apply a greater amount of pressure than the first piston. The force and pressure applied by the second piston are applied to the downhole element. Further, the force and pressure applied by the second piston are greater than a threshold amount of force and pressure to set the downhole element. For example, where the downhole element is a packer, the force and pressure applied by the second piston is greater than the threshold amount of force and pressure to set the downhole piston at a desired location. In some embodiments, where the downhole element is retained by a retaining element of the hydrostatic pressure intensifier, the amount of pressure applied by the second piston to the downhole element is greater than the threshold amount of pressure to dislodge the downhole element from the retaining element and set the downhole element. In some embodiments, the first piston and/or the second piston are also hydraulically actuated to set the downhole element.

In some embodiments, the hydrostatic pressure intensifier also includes a fluid flow restrictor that restricts fluid flow to control the amount of force applied by the first piston. In one or more embodiments, the fluid flow restrictor restricts the amount of fluid flow through the device into the housing. In one or more embodiments, where the first chamber and the second chamber are separated by a fluid chamber, the fluid flow restrictor restricts the fluid flow of the fluid in the fluid chamber, thereby controlling the force applied by the first piston to the second piston. Additional details of the foregoing hydrostatic pressure intensifier, methods to deploy a hydrostatic pressure intensifier, and methods to hydrostatically set a downhole element are provided in the paragraphs below and are illustrated in at least FIGS. 1-4.

Figure 1B:
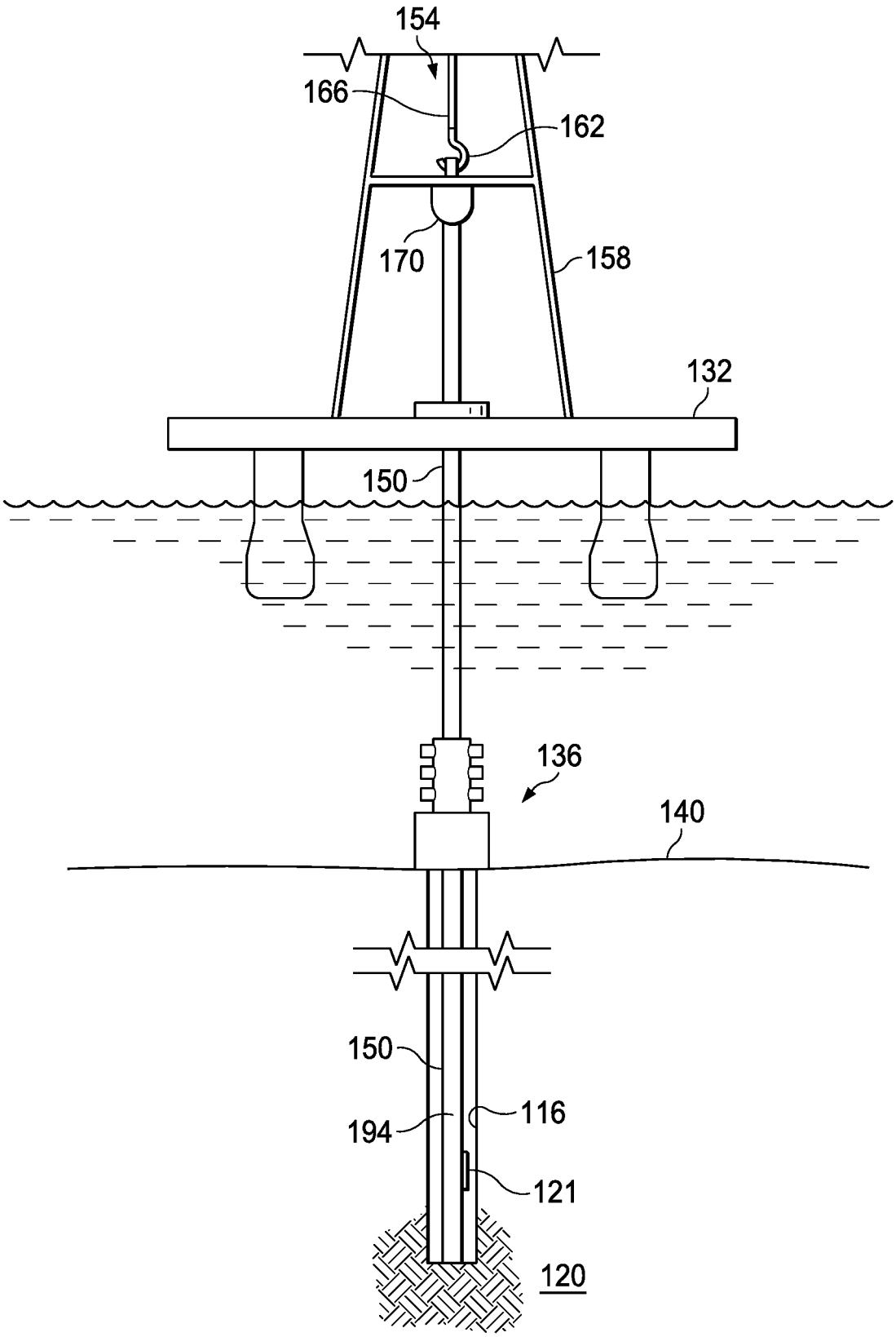
FIG. 1B illustrates a schematic view of an off-shore platform having a hydrostatic pressure intensifier deployed in the well.

Now turning to the figures, FIG. 1A illustrates a schematic view of an on-shore well 112 having a hydrostatic pressure intensifier 121 deployed in the well 112. The well 112 includes a wellbore 116 that extends from surface 108 of the well 112 to a subterranean substrate or formation 120. The well 112 and rig 104 are illustrated onshore in FIG. 1A. Alternatively, FIG. 1B illustrates a schematic view of an off-shore platform 132 having a hydrostatic pressure intensifier 121 according to an illustrative embodiment. The hydrostatic pressure intensifier 121 in FIG. 1B may be deployed in a sub-sea well 136 accessed by the offshore platform 132. The offshore platform 132 may be a floating platform or may instead be anchored to a seabed 140.

In the embodiments illustrated in FIGS. 1A and 1B, the wellbore 116 has been formed by a drilling process in which dirt, rock and other subterranean material is removed to create the wellbore 116. During or after the drilling process, a portion of the wellbore 116 may be cased with a casing (not illustrated). In other embodiments, the wellbore 116 may be maintained in an open-hole configuration without a casing. The embodiments described herein are applicable to either cased or open-hole configurations of the wellbore 116, or a combination of cased and open-hole configurations in a particular wellbore.

After drilling of the wellbore 116 is complete and the associated drill bit and drill string are "tripped" from the wellbore 116, a work string 150 which may eventually function as a production string is lowered into the wellbore 116. In some embodiments, the work string 150 includes an annulus 194 disposed longitudinally in the work string 150 that provides fluid communication between the surface 108 of the well 112 and a downhole location in the formation 120.

The lowering of the work string 150 may be accomplished by a lift assembly 154 associated with a derrick 158 positioned on or adjacent to the rig 104 or offshore platform 132. The lift assembly 154 may include a hook 162, a cable 166, a traveling block (not shown), and a hoist (not shown) that cooperatively work together to lift or lower a swivel 170 that is coupled to an upper end of the work string 150. The work string 150 may be raised or lowered as needed to add additional sections of tubing to the work string 150 to position the hydrostatic pressure intensifier 121 at the downhole location in the wellbore 116.

Figure 2:
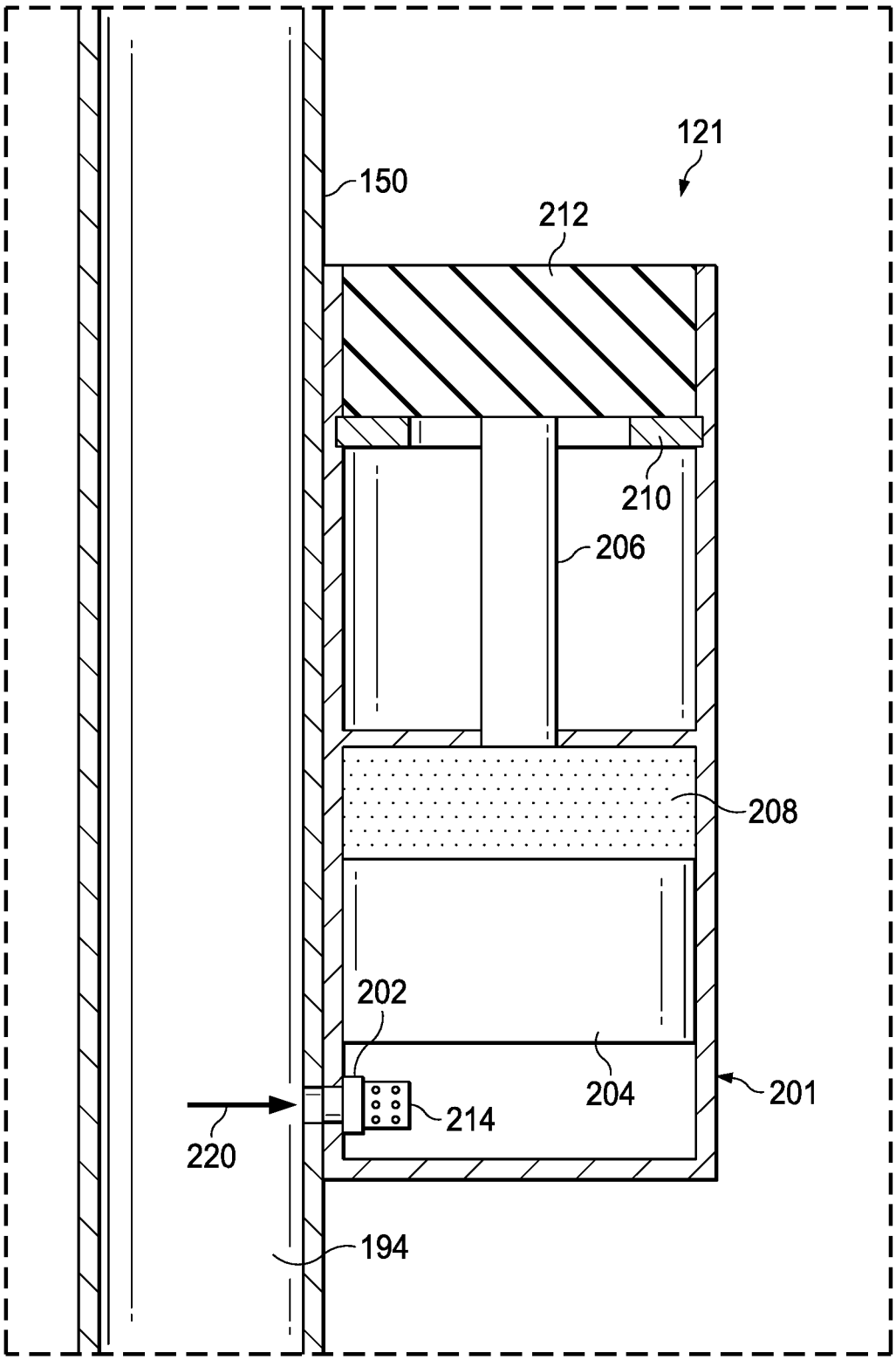
FIG. 2 illustrates a detailed cross-sectional view of the hydrostatic pressure intensifier of FIGS. 1A and 1B.

As described herein and illustrated in at least FIG. 2, the hydrostatic pressure intensifier 121 contains a device that is actuated when a threshold amount of pressure is applied to the device.

A surface-based fluid flows from the inlet conduit 186, through the annulus 194 of the work string 150. In the embodiments of FIGS. 1A and 1B, the work string 150 has an opening (not shown) that is aligned with the device or allows fluid to flow through the opening towards the device. Further, fluid flowing through the opening applies at least the threshold amount of pressure to actuate the device, thereby allowing fluid to flow into the housing of the hydrostatic pressure intensifier 121. In some embodiments, where the fluid is a formation fluid, the device is positioned to allow the formation fluid to apply the threshold amount of pressure to the device to actuate the device. The work string 150 is also connected to an outlet conduit 198. During certain operations, fluid (e.g., formation fluid, drilling fluid, hydrocarbon resources, etc.) also flows into the annulus 194 of the work string 150, where the fluids flow through an outlet conduit 198 into a container 178. In some embodiments, a pump (not shown) pumps the fluid to the surface 108.

Although FIGS. 1A and 1B illustrate completion environments, the hydrostatic pressure intensifier 121 may also be deployed in various production environments or drilling environments where fluid may be guided to the hydrostatic pressure intensifier 121. Further, although FIGS. 1A and 1B illustrate a single hydrostatic pressure intensifier 121, multiple hydrostatic pressure intensifiers may be deployed in the well 112. In some embodiments, where it is desirable to set multiple packers or other downhole elements to isolate one or more sections of the well 112 and/or to divide the well 112 into multiple zones, multiple hydrostatic pressure intensifiers are simultaneously deployed downhole to set the respective packers. In another one of such embodiments, the wellbore 116 is a multilateral wellbore. In such embodiment, one or more hydrostatic pressure intensifiers 121 described herein may be deployed in each lateral wellbore of the multilateral wellbore to set packers and other downhole elements at the desired locations of each lateral wellbore. Further, although FIGS. 1A and 1B illustrate open-hole configurations, the hydrostatic pressure intensifier 121 described herein may also be deployed in cased-hole configurations. Further, in some embodiments, the hydrostatic pressure intensifier 121 is coupled to or includes one or more screens and/or filters to prevent contaminants, solid particles, or other undesirable particles from flowing into the hydrostatic pressure intensifier 121. Additional details of the hydrostatic pressure intensifier 121 are provided in the paragraphs below and are illustrated in at least FIGS. 2-4.

FIG. 2 illustrates a detailed cross-sectional view of the hydrostatic pressure intensifier 121 of FIGS. 1A and 1B. In the illustrated embodiment, a device 202 is mounted to a side of the hydrostatic pressure intensifier 121. The device 202 is shut while less than a first threshold amount of pressure is applied to the device 202, thereby sealing the interior of the housing 201. In some embodiments, the device 202 is a valve that is shut when less than the first threshold amount of pressure is applied to the device 202, and is open when at least the first threshold amount of pressure is applied to the device 202. In some embodiments, the device 202 is a shiftable sleeve that actuates to provide an opening into the housing 201. In some embodiments, the device 202 is a rupture disc or another type of non-reclosing pressure relief device having a membrane that fails when subject to the first threshold amount of pressure.

A first piston 204 and a second piston 206 are both fitted in the housing 201 of the hydrostatic pressure intensifier 121. In the illustrated embodiment, the cross-sectional area of first piston 204 is greater than the cross-sectional area of the second piston 206. In some embodiments, the first piston 204 and the second piston 206 have the same stroke length. In other embodiments, the first piston 204 and the second piston 206 have different stroke lengths. Further, in some embodiments, the first piston 204 and the second piston 206 are mechanically linked to each other. In the illustrated embodiment, the first piston 204 and the second piston 206 are separated by an atmospheric chamber 208. In some embodiments, the first piston 204 and the second piston 206 are separated by a fluid chamber that is partially filled with a fluid. In some embodiments, the first piston 204 and the second piston 206 are not separated from each other by a chamber, and are in physical contact with each other.

The hydrostatic pressure intensifier 121 also includes a fluid flow restrictor 214 that controls the fluid flow through the hydrostatic pressure intensifier 121. In one or more embodiments, the fluid flow restrictor 214 has a tortuous path that restricts flow of fluids through the fluid flow restrictor 214. In the illustrated embodiment of FIG. 2, the fluid flow restrictor 214 is coupled to the device 202. In some embodiments, the fluid flow restrictor 214 is deployed at another location to control the fluid flow through the hydrostatic pressure intensifier 121. In the illustrated embodiment, the hydrostatic pressure intensifier 121 also includes a retaining element 210 that retains a packer 212 if less than a second threshold amount of pressure is applied to the retaining element 210. In some embodiments, the retaining element 210 is a retaining ring. In some embodiments, the retaining element 210 is a shear ring or another type of element that retains the packer 212 if the retaining element 210 is not subject to the second threshold amount of pressure. In the illustrated embodiment of FIG. 2, pressure is applied by a fluid flowing through the annulus 194 and in a direction indicated by arrow 220.

The device 202 actuates after the first threshold amount of pressure is applied to the device 202, thereby allowing fluid to flow into the interior of the housing 201. The fluid exerts a force on the first piston 204, thereby actuating the first piston 204. The actuation of the first piston 204 exerts a force on the second piston 206, thereby also actuating the second piston 206. Further, the actuation of the second piston 206 exerts a force on the retaining element 210. In some embodiments, the force exerted by the first piston 204 on the second piston 206, and the force exerted by the second piston 206 on the retaining element 210 is approximately equal to each other. However, the cross-sectional area of the first piston 204 is larger than the cross-sectional area of the second piston 206. Given that an approximate amount of force is exerted by both the first piston 204 and the second piston 206, and that pressure is equal to force over area, the amount of pressure exerted by the second piston 206 on the retaining element 210 is greater than the amount of pressure exerted by the first piston 204 on the second piston 206. In the illustrated embodiment, the amount of pressure exerted by the second piston 206 is greater than the second threshold amount of pressure, thereby causing the packer 212 to dislodge from the hydrostatic pressure intensifier 121. In the illustrated embodiment, the amount of pressure exerted by the second piston 206 also sets the packer 212 at the desired location. Although the device 202 of FIG. 2 is positioned next to an opening of the work string 150, in some embodiments, the device 202 is positioned proximate the borehole to allow formation fluids or other types of fluids in the wellbore to exert pressure on the device 202. Further, although the hydrostatic pressure intensifier 121 of FIG. 2 has two pistons 204 and 206, in some embodiments, a hydrostatic pressure intensifier includes three or more pistons having different cross-sectional areas, which allows the pistons to exert different amounts of pressure in response to being subject to an identical amount of force.

Figure 3:
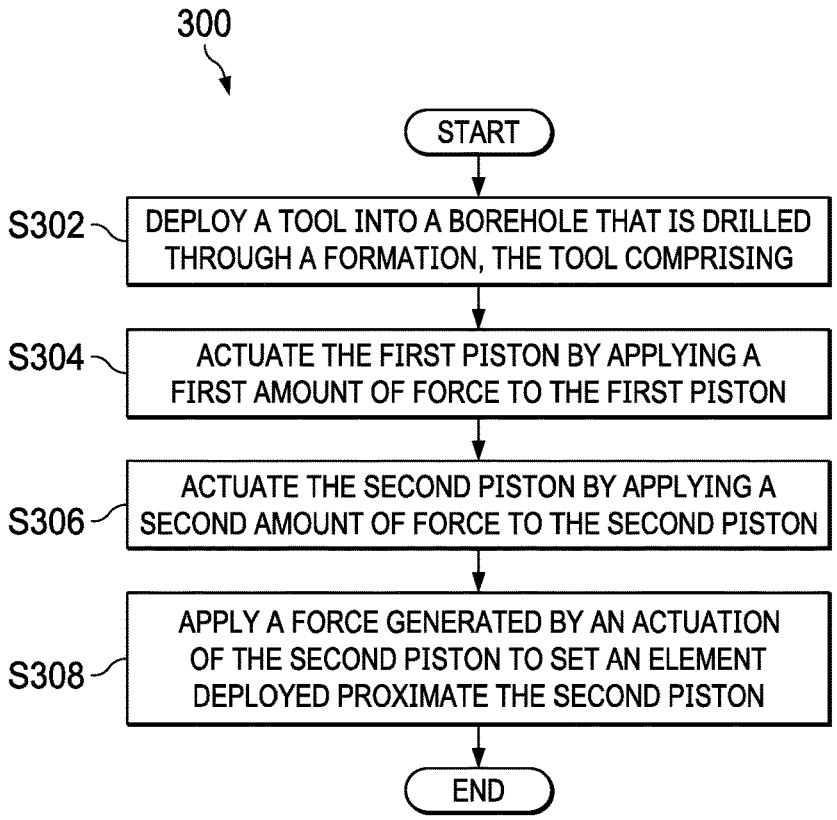
FIG. 3 is a flow chart of a process to operate a hydrostatic pressure intensifier of FIGS. 1A-1B to set a downhole element.

FIG. 3 is a flow chart of a process to operate a hydrostatic pressure intensifier of FIGS. 1A-1B to set a downhole element. Although the operations in the process 300 are shown in a particular sequence, certain operations may be performed in different sequences or at the same time where feasible. At block S302, a downhole tool, such as the hydrostatic pressure intensifier 121 of FIGS. 1A-1B and 2, is deployed into a borehole that is drilled through a formation. Both the first piston and the second piston are fitted in a housing of the tool. In some embodiments, a device mounted on the tool provides fluid access to the pistons if a threshold amount of pressure is applied to the device. The tool includes a first piston that has a first cross-sectional area and a first stroke length, and a second piston that has a second cross-sectional area and a second stroke length. At block S304, a first amount of force is applied to the first piston to actuate the first piston. In some embodiments, fluid flowing into the housing applies the first amount of force to the first piston. In some embodiments, where the first piston is hydraulically activated, the first amount of force is a hydraulic force. In some embodiments, the first amount of force is a combination of hydraulic and hydrostatic force. In some embodiments, the tool also includes a fluid flow restrictor that regulates fluids flowing into the tool. In one or more of such embodiments, fluid flowing into the tool is regulated to control the amount of force applied to the first piston. At block S306, a second amount of force is applied to the second piston to actuate the second piston. In some embodiments, where the second piston is hydraulically activated, the second amount of force is a hydraulic force. In some embodiments, the second amount of force is a combination of hydraulic and hydrostatic force.

At block S308, the force generated by an actuation of the second piston is applied to a downhole element that is deployed proximate the second piston to set the downhole element. In some embodiments, the force applied by the first piston is approximately equal to the force applied to the second piston. However, since the cross-sectional area of the first piston is greater than the cross-sectional area of the second piston, the pressure generated by the first piston on the second piston is less than the pressure generated by the second piston on the downhole element. In some embodiments, the downhole element is a packer. In one or more of such embodiments, the force and pressure exerted by the second piston on the packer sets the packer at the desired location.

Figure 4:
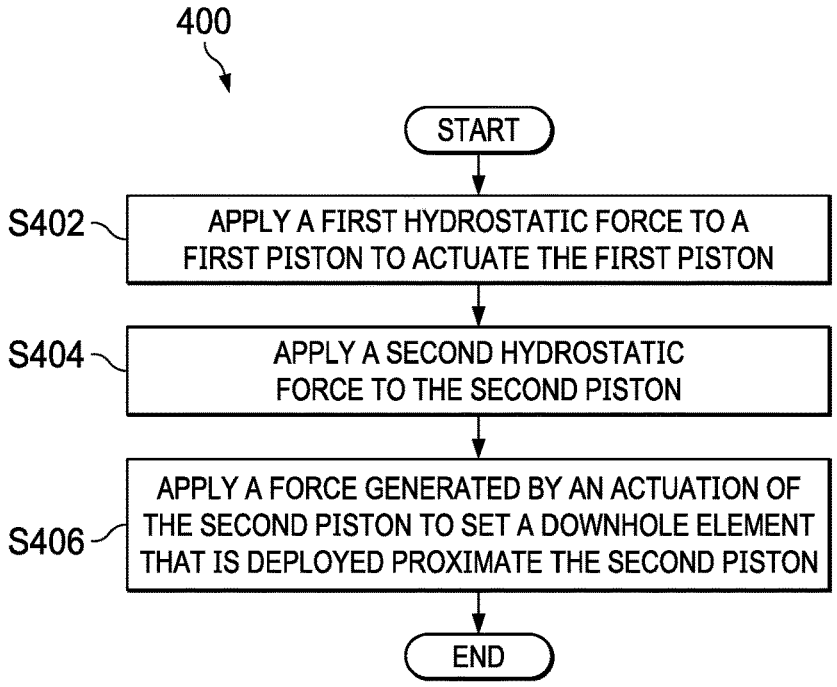
FIG. 4 is a flow chart of a process to hydrostatically set a downhole element.

FIG. 4 is a flow chart of a process to hydrostatically set a downhole element. Although the operations in the process 400 are shown in a particular sequence, certain operations may be performed in different sequences or at the same time where feasible. At block S402, a first hydrostatic force is applied to a first piston to actuate the first piston. As described herein, the first piston and a second piston are both deployed in a borehole. In the embodiment of FIGS. 1A, 1B, and 2, both pistons are components of the hydrostatic pressure intensifier 121. Further, the first piston has a first cross-sectional area and wherein the second piston has a second cross-sectional area that is less than the first cross-sectional area. In some embodiments, the first hydrostatic force is exerted by a fluid (e.g., wellbore fluid, drilling fluid, formation fluid, etc.). In some embodiments, the fluid flow of the flow is regulated to control the amount of force applied to the first piston.

At block S404, a second hydrostatic force is applied to the second piston, where the second hydrostatic force is generated by an actuation of the first piston. At block S406, a force generated by an actuation of the second piston is applied to a downhole element that is deployed proximate the second piston to set the downhole element. The first hydrostatic force generates a first amount of pressure to the second piston, and the second hydrostatic force generates a second amount of pressure to the element. However, since the first cross-sectional area of the first piston is greater than the second cross-sectional area of the second piston, and where the first hydrostatic force is approximately equal to the second hydrostatic force, the pressure exerted by the second piston on the downhole element is greater than the pressure exerted by the first piston on the second piston.

In some embodiments, the in-situ formation property measurement tool 120 includes one or more containers for storing a sample of the injection fluid (or another type of fluid). In some embodiments, the in-situ formation property measurement tool 120 includes a drill cutting tool operable of extracting a sample core from the formation. In one or more of the foregoing embodiments, the in-situ formation property measurement tool 120 is also operable of transporting the sample of the injection fluid and the sample core to another location downhole or to the surface for fluid analysis of the stored sample and the sample core.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure:

Clause 1, a hydrostatic pressure intensifier, comprising a housing having at least two different internal cross-sectional surface areas, the housing comprising a device mounted on the housing and operable to actuate in response to being subject to a threshold amount of pressure; a first piston housed in a first chamber of the housing, wherein the first piston has a first cross-sectional area and a first stroke length; and a second piston housed in a second chamber of the housing, wherein the second piston has a second cross-sectional area and a second stroke length, and wherein the first cross-sectional area is greater than the second cross-sectional area; and a fluid flow restrictor that restricts fluid flow through the hydrostatic pressure intensifier to control an amount of force applied by the first piston.

Clause 2, the hydrostatic pressure intensifier of clause 1, further comprising a chamber that separates the first piston and the second piston, wherein the chamber is a fluid chamber that is partially filled with a fluid.

Clause 3, the hydrostatic pressure intensifier of clause 1, further comprising a chamber that separates the first piston and the second piston, wherein the chamber is an atmospheric chamber.

Clause 4, the hydrostatic pressure intensifier of any of causes 1-3, wherein the device is a check valve.

Clause 5, the hydrostatic pressure intensifier of any of clauses 1-3, wherein the device is a rupture disk.

Clause 6, the hydrostatic pressure intensifier of any of clauses 1-5, wherein the first piston and the second piston are mechanically linked.

Clause 7, the hydrostatic pressure intensifier of any of clauses 1-6, wherein the first stroke length and the second stroke length are different.

Clause 8, the hydrostatic pressure intensifier of any of clauses 1-7, wherein the first piston is a hydraulic piston and wherein the second piston is a hydrostatic piston.

Clause 9, the hydrostatic pressure intensifier of clauses 1-7, wherein the first piston and the second piston are hydrostatic pistons.

Clause 10, the hydrostatic pressure intensifier of any of clauses 1-9, wherein the first piston and the second piston are hydraulically activated.

Clause 11, the hydrostatic pressure intensifier of any of clauses 1-10, further comprising an element retaining ring that retains an element while a pressure less than a threshold is exerted onto the element retaining ring.

Clause 12, the hydrostatic pressure intensifier of any of clauses 1-11, wherein the fluid chamber comprises an orifice that allows a fluid filled in the fluid chamber to flow through the fluid chamber, and into the second chamber to apply a pressure to the second piston.

Clause 13, a method to operate a tool to set a downhole element, the method comprising: deploying a tool into a borehole that is drilled through a formation, the tool comprising: a first piston having a first cross-sectional area and a first stroke length; and a second piston having a second cross-sectional area and a second stroke length; actuating the first piston by applying a first amount of force to the first piston; actuating the second piston by applying a second amount of force to the second piston, wherein the second amount of force is generated by an actuation of the first piston; and applying a force generated by an actuation of the second piston to set an element deployed proximate the second piston, wherein the first amount of force generates a first amount of pressure to the second piston, and wherein the second amount of force generates a second amount of pressure to the element, and wherein the first amount of pressure is less than the second amount of pressure.

Clause 14, the method of clause 13, wherein applying the first amount of force to the first piston comprises applying the first amount of hydraulic force to the first piston, and wherein applying the second amount of force to the second piston comprises applying the second amount of hydrostatic force to the second piston.

Clause 15, the method of claim 13, wherein applying the first amount of force to the first piston comprises applying the first amount of hydrostatic force to the first piston, and wherein applying the second amount of force to the second piston comprises applying the second amount of hydrostatic force to the second piston.

Clause 16, the method of any of clauses 13-15, wherein the tool comprises a device that is actuated if at least a threshold amount of pressure is applied to the device, and is not actuated if the threshold amount of pressure is not applied to the device, and the method further comprising actuating the first piston after at least the threshold amount of pressure is applied to the device.

Clause 17, the method of clause 16, further comprising regulating fluid flow through the tool to control the first amount of force applied to the first piston.

Clause 18, the method of any of clauses 13-17, wherein the element is a packing element, and wherein applying a force generated by an actuation of the second piston to set the element comprises applying the force generated by the actuation of the second piston to set the packing element.

Clause 19, a method to hydrostatically set a downhole element, the method comprising: applying a first hydrostatic force to a first piston to actuate the first piston, wherein the first piston and a second piston are both deployed in a borehole, wherein the first piston has a first cross-sectional area and wherein the second piston has a second cross-sectional area that is less than the first cross-sectional area; applying a second hydrostatic force to the second piston to actuate the second piston, wherein the second hydrostatic force is generated by an actuation of the first piston; and applying a force generated by an actuation of the second piston to set a downhole element that is deployed proximate the second piston, wherein the first hydrostatic force generates a first amount of pressure to the second piston, and wherein the second hydrostatic force generates a second amount of pressure to the element, and wherein the first amount of pressure is less than the second amount of pressure.

Clause 20, the method of clause 19, further comprising regulating fluid flow to the first piston to control the first hydrostatic force applied to the first piston.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A hydrostatic pressure intensifier, comprising:

a housing having at least two different internal cross-sectional surface areas, the housing comprising:

a device mounted on the housing and operable to actuate in response to being subject to a threshold amount of pressure;

a first piston housed in a first chamber of the housing, wherein the first piston has a first cross-sectional area and a first stroke length; and a second piston housed in a second chamber of the housing, wherein the second piston has a second cross-sectional area and a second stroke length, and wherein the first cross-sectional area is greater than the second cross-sectional area;

a third chamber positioned between the first chamber and the second chamber, the third chamber separating the first piston from the second piston, the third chamber having a first portion in contact with the first piston and a second portion in contact with the second piston; and a fluid flow restrictor that restricts fluid flow through the hydrostatic pressure intensifier to control an amount of force applied by the first piston.

2. The hydrostatic pressure intensifier of claim 1, wherein the third chamber is a fluid chamber that is partially filled with a fluid.

3. The hydrostatic pressure intensifier of claim 1, wherein the third chamber is an atmospheric chamber.

4. The hydrostatic pressure intensifier of claim 1, wherein the device is a check valve.

5. The hydrostatic pressure intensifier of claim 1, wherein the device is a rupture disk.

6. The hydrostatic pressure intensifier of claim 1, wherein the first piston and the second piston are mechanically linked.

7. The hydrostatic pressure intensifier of claim 1, wherein the first stroke length and the second stroke length are different.

8. The hydrostatic pressure intensifier of claim 1, wherein the first piston is a hydraulic piston and wherein the second piston is a hydrostatic piston.

9. The hydrostatic pressure intensifier of claim 1, wherein the first piston and the second piston are hydrostatic pistons.

10. The hydrostatic pressure intensifier of claim 9, wherein the first piston and the second piston are hydraulically activated.

11. The hydrostatic pressure intensifier of claim 1, further comprising an element retaining ring that retains an element while a pressure less than a threshold is exerted onto the element retaining ring.

12. The hydrostatic pressure intensifier of claim 1, wherein the third chamber is a fluid chamber that comprises an orifice that allows a fluid filled in the fluid chamber to flow through the fluid chamber, and into the second chamber to apply a pressure to the second piston.

13. A method to operate a tool to set a downhole element, the method comprising:

deploying a tool into a borehole that is drilled through a formation, the tool comprising:

one and only one device mounted on the housing and operable to actuate in response to being subject to a threshold amount of pressure to provide fluid flow into the tool;

a first piston having a first cross-sectional area and a first stroke length; and a second piston having a second cross-sectional area and a second stroke length; flowing fluid through the one and only one device;

actuating the first piston by applying a first amount of force to the first piston; actuating the second piston by applying a second amount of force to the second piston, wherein the second amount of force is generated by an actuation of the first piston; and applying a force generated by an actuation of the second piston to set an element deployed proximate the second piston, wherein the first amount of force generates a first amount of pressure to the second piston, and wherein the second amount of force generates a second amount of pressure to the element, and wherein the first amount of pressure is less than the second amount of pressure, and wherein fluid flow through the one and only device causes the force generated by the actuation of the second piston to set the element.

14. The method of claim 13, wherein applying the first amount of force to the first piston comprises applying the first amount of hydraulic force to the first piston, and wherein applying the second amount of force to the second piston comprises applying the second amount of hydrostatic force to the second piston.

15. The method of claim 13, wherein applying the first amount of force to the first piston comprises applying the first amount of hydrostatic force to the first piston, and wherein applying the second amount of force to the second piston comprises applying the second amount of hydrostatic force to the second piston.

16. The method of claim 13, wherein the tool comprises a device that is actuated if at least a threshold amount of pressure is applied to the device, and is not actuated if the threshold amount of pressure is not applied to the device, and the method further comprising actuating the first piston after at least the threshold amount of pressure is applied to the device.

17. The method of claim 16, further comprising regulating fluid flow through the tool to control the first amount of force applied to the first piston.

18. The method of claim 13, wherein the element is a packing element, and wherein applying a force generated by an actuation of the second piston to set the element comprises applying the force generated by the actuation of the second piston to set the packing element.

19. A method to hydrostatically set a downhole element, the method comprising:

flowing fluid through one and only one device to provide fluid flow into a tool;

applying a first hydrostatic force to a first piston to actuate the first piston, wherein the first piston and a second piston are both deployed in a borehole, wherein the first piston has a first cross-sectional area and wherein the second piston has a second cross-sectional area that is less than the first cross-sectional area;

applying a second hydrostatic force to the second piston, wherein the second hydrostatic force is generated by an actuation of the first piston; and applying a force generated by an actuation of the second piston to set a downhole element that is deployed proximate the second piston, wherein the first hydrostatic force generates a first amount of pressure to the second piston, and wherein the second hydrostatic force generates a second amount of pressure to the element, and wherein the first amount of pressure is less than the second amount of pressure and wherein fluid flow through the one and only one device causes the force generated by the actuation of the second piston to set the downhole element.

20. The method of claim 19, further comprising regulating fluid flow to the first piston to control the first hydrostatic force applied to the first piston.

* * * * *